United States Patent [19]

Verbauwhede et al.

[11] Patent Number: 4,623,281

[45] Date of Patent: Nov. 18, 1986

[54] OPEN-MESH FABRIC

[75] Inventors: Germain Verbauwhede; Roger Vanassche, both of Zwevegem, Belgium

[73] Assignee: N.V. Bekaert S.A., Zwevegem, Belgium

[21] Appl. No.: 634,568

[22] Filed: Jul. 26, 1984

[30] Foreign Application Priority Data

Aug. 2, 1983 [NL] Netherlands ..... 8302739

[51] Int. Cl.[4] ..... E02B 3/12; D03D 15/02

[52] U.S. Cl. ..... 405/19; 139/425 R; 428/256

[58] Field of Search ..... 405/15, 16, 17, 19, 405/32; 139/425 R; 428/247, 255, 256

[56] References Cited

U.S. PATENT DOCUMENTS

| | | | |
|---|---|---|---|
| 2,024,806 | 12/1935 | Disbro et al. | 139/425 R |
| 2,052,808 | 9/1936 | Spokes | 428/256 X |
| 2,092,183 | 9/1937 | Rehfeld | 405/19 |
| 2,361,163 | 10/1944 | Arthur | 405/19 X |
| 2,922,442 | 1/1960 | Webber | 139/425 |
| 3,928,696 | 12/1975 | Wandel et al. | 405/19 X |
| 4,002,188 | 1/1977 | Hanks | 139/425 R X |
| 4,239,795 | 12/1980 | Haage et al. | 428/247 |

FOREIGN PATENT DOCUMENTS

| | | | |
|---|---|---|---|
| 3120661 | 12/1982 | Fed. Rep. of Germany . | |
| 2076016 | 10/1971 | France . | |
| 6803322 | 9/1969 | Netherlands | 405/19 |

*Primary Examiner*—David H. Corbin

*Attorney, Agent, or Firm*—Schwartz, Jeffery, Schwaab, Mack, Blumenthal & Evans

[57] ABSTRACT

Disclosed is a dimensionally stable, flexible and open-mesh woven fabric comprising a warp and a weft comprised of thread-like elements, wherein the warp elements are arranged in groups spaced apart from each other, wherein the distance between each two successive groups as well as the distance between each two successive wefts is between about 0.8 cm and 6 cm, and wherein the clamping force of a group of the warp elements on the weft elements is such that an axial movement of the weft elements occurs only in the case of an axial tensile loading of at least about 1% of the breaking strength of the weft elements.

19 Claims, 4 Drawing Figures

FIG.1
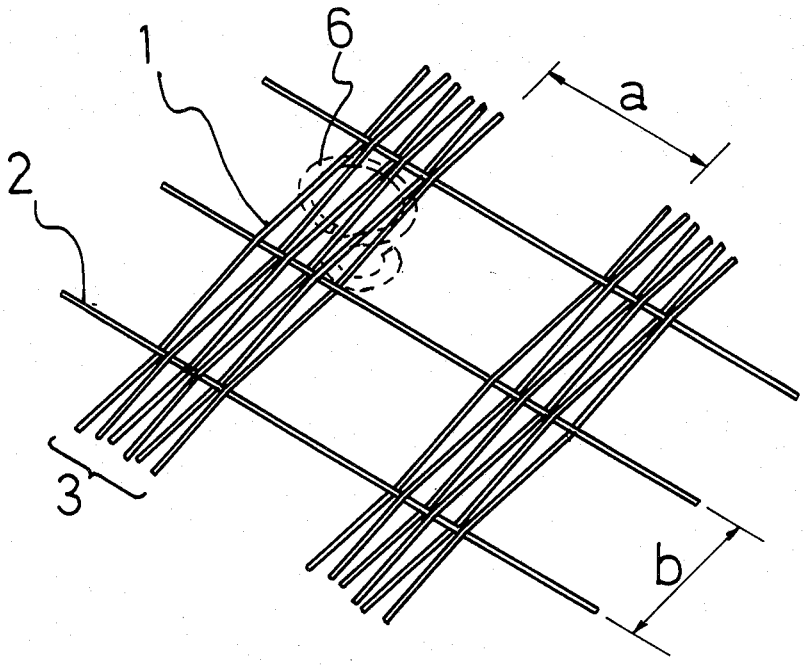
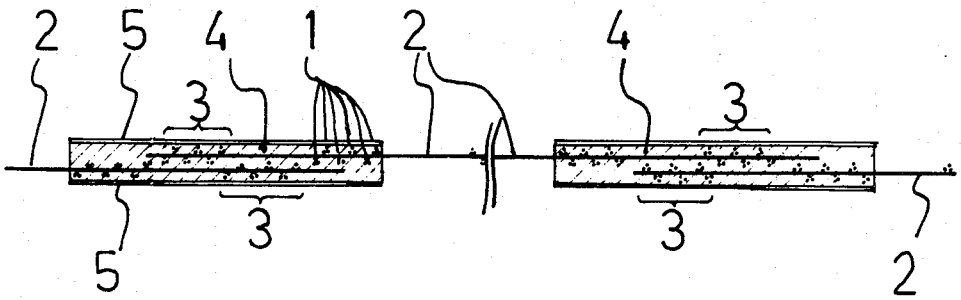
FIG.2

OPEN-MESH FABRIC

BACKGROUND OF THE INVENTION

The present invention relates to an open-mesh, flexible and dimensionally stable woven fabric of wire elements, e.g., wire strands or cords, which in particular is usable as an underwater covering mat.

In civil engineering work, it is known to use covering mats for river-beds or banks, for dams or dikes, in order to protect them against erosion by waves or currents. These mats may comprise a supporting netting to which ballast blocks, for example, asphalt plates, are attached.

SUMMARY OF THE INVENTION

It is an object of the present invention to provide such a woven netting, which in particular possesses the characteristic of retaining its dimensional stability when loaded with ballast elements despite its small weight (open-mesh) and its pronounced flexibility. This flexibility is required as the fabric must faithfully follow and adjust itself to the contour and unevenness of the bed or bank to be covered. This dimensional stability requires that the warp and weft wires in the fabric can shift only a little with respect to each other under the influence of the ballast weights which are attached at spaced locations to the fabric, for example, by means of binding wires or cords or hooks. Hence, the meshes should not excessively deform in the areas where the ballast weights are attached. This means that it should be prevented that the fabric locally elongates or contracts in the attachment areas and thereby forms bulges. Therefore, it will be necessary to use warp and weft elements which possess a high tensile modulus (and, if possible, also a high bending modulus).

At the launch of a ballast-loaded covering mat, for example, to the sea-bottom at a typical depth of some 30 meters, usually the mat is unrolled from a ship and it is lowered to the sea-bottom (substantially vertically) over the zones to be covered in order to stabilize these zones, for example, in the construction of pillars for bridges, walls for harbors, docks, locks, etc. This hanging and weight-loaded mat must therefore be capable of sustaining a large tensile force when being lowered. The fabric warp, which extends in the unrolling direction, must be adapted for this purpose. Therefore, the fabric strength in the warp direction will normally be selected higher than in the weft direction. Since, apart from the higher strength, the flexibility of the fabric must also remain assured in the warp direction, no warp elements are used which are an order of magnitude thicker and hence more rigid than the weft elements. The wire elements in the warp shall therefore have a tensile strength and a rigidity of the same order of magnitude as those in the weft.

According to the present invention, these requirements of flexibility, strength and mesh stability (under ballast loading) are met by arranging the warp wires in groups and by selecting the distance "a" between each two successive warp groups, as well as the distance "b" between every two successive weft elements between about 0.8 cm and 6 cm. To prevent shifting of the warp and weft elements under local lengthwise or crosswise tensile forces, it is necessary that, in addition, the clamping or holding force of the warp elements per warp group on the weft elements is sufficiently high. According to the present invention, this holding force is sufficient when the weft elements start to shift in their axial direction in the fabric only when they are subjected to an axial tensile load of at least about 1% of their tensile strength (or breaking load in tension). For a number of applications, it will be necessary that this holding force is such that the weft elements only start to shift in the axial direction when they are loaded in tension in the fabric to about 2% or more of their strength. Finally, in some cases, it may be necessary to reach such a holding force that the weft elements start to shift in the axial direction only when they are loaded to above 10% of their tensile strength.

BRIEF DESCRIPTION OF THE DRAWINGS

In the drawings:

FIG. 1 is a perspective view of a fabric according to the present invention;

FIG. 2 is a cross-sectional view of the connection zones of the fabric longitudinal edges;

DETAILED DESCRIPTION OF PREFERRED EMBODIMENTS

The fabric according to FIG. 1 comprises warp elements 1 which alternately extend under and over the weft elements 2, so that these elements 2 are clamped between the elements 1. To guarantee a sufficient clamping and, as a result, mesh stability, it has proven to be advantageous to use elements with a high tensile modulus and bending modulus such as, for example, steel cords. Warp and weft cords may possess the same construction. The warp elements 1 are arranged in groups 3, which preferably comprise an even number of identical elements 1, more specifically between one and fifteen. In this manner, the elements 1 in the group are most uniformly loaded.

The clamping force on the weft cords will rise in accordance with an increase of the rigidity of the warp (and weft) cords and as the distance "b" between successive weft cords becomes smaller, since in this way the sinusoidal deformation of the warp cords becomes more pronounced. However, an excessive sinusoidal deformation of the warp cords reduces their tensile strength in the fabric. Therefore, in this case, it will be necessary to seek an optimal compromise. It is evident that this clamping force will also increase when the warp elements are loaded in tension, for example, under the influence of the attached ballast weights when the fabric hangs down in the warp direction. Furthermore, it may be stated that a sufficient clamping force of the warp steel cords on the weft steel cords is present in an unloaded fabric when the following equation is met:

$$15\,D \leqq \frac{b}{\Sigma n_i d_i^4} \leqq 60\,D$$

where D is the thickness of the weft cords (measured crosswise to the fabric), $d_i$ is the diameter of the filament i in a warp cord and $n_I$ is the number of filaments with diameter $d_i$ in this cord. The Σ symbol refers to the total number of the filaments in one warp cord.

Furthermore, the present invention also relates to a fabric comprising a number of juxtaposed fabrics of the type described above. The longitudinal edges of these fabrics overlap and are mutually connected, for example, by means of vulcanized rubber strips 4 as shown in FIG. 2. This fabric strip can be loaded by attaching ballast weights or floats at spaced locations.

For easy handling, the lateral ends of the fiber fabric are provided with a plate connection, which may be vulcanized to the fabric end.

Figure 3:
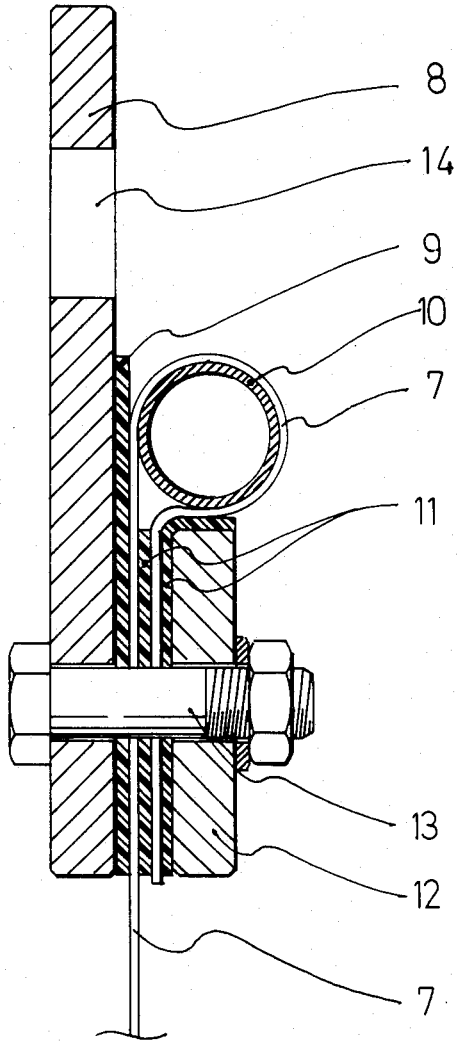
FIG. 3 is a cross-sectional view of the end connection of the fabric strip.
Figure 4:
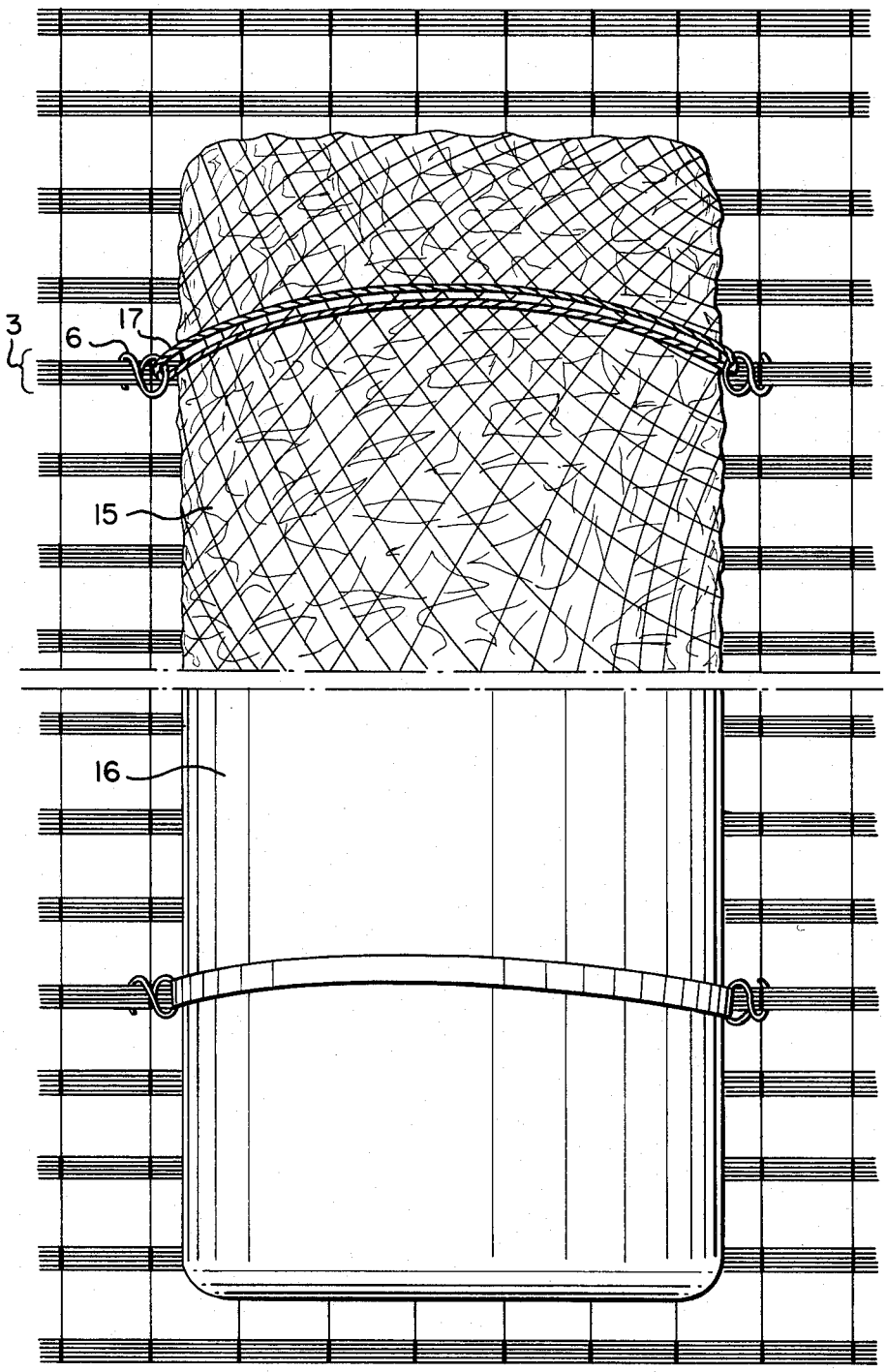
FIG. 4 is a split top view of a fabric strip of the invention showing the attachment of a ballast and a float member.

FIG. 3 is a cross-sectional view of a suitable end connection construction for a fabric strip which is to be loaded with ballast weights. This end connection comprises a thick steel plate 8 which is connected to the fabric end 7 via the insertion of a rubber strip 9. This fabric end is looped around a tube 10 and clamped between the plate 8 and the counterplate 12 by means of the insertion of extra rubber strips 11. The plates 8 and 12 are bolted together at regular intervals by means of clamping bolts 13. The fabric end can be handled by inserting hooks in suitable bores 14 in plate 8. In FIG. 4 are shown the use of a ballast weight 15 and a float member 16 on the fabric. Attachment of the ballast or float can be by means well known in the art such as a cord 17 having at each end a hook 6 which engages a warp group 3.

Steel is the most preferred material for the warp and weft elements because of its proper stiffness characteristics and tensile strength. The diameter d of the filaments is preferably between 0.10 mm and 2 mm. The tensile strength should range between about 400 and 3500N/mm$^2$.

EXAMPLE

A woven steel cord fabric with the following parameters was made: the zinc-coated warp and weft cords (of high-carbon steel) have a construction $3\times0.60$ (i.e., 3 twisted steel filaments each with a diameter of 0.6 mm). The cord thickness was substantially 1.3 mm and the breaking load approximately 1950N.

The width of each warp group of 6 cords was approximately 12 mm, while the distance "b" was equal to approximately 18 mm, and the distance "a" was equal to approximately 28 mm. A piece 41 cm wide (containing ten warp cord groups) and 2 m long was cut out of this fabric. The warp cords were held at both ends without applying a tension in the warp direction. Subsequently one weft cord was axially pulled near the middle of the piece near one longitudinal edge of the fabric, while the two adjacent weft cords (one on the left and one on the right) were held at the opposite longitudinal edge of the piece. An axial extraction force of 450N was required. Per warp group, the extraction force was on an average $450N\div10=45N$ which is approximately 2% of the breaking strength of the weft cord.

A number of woven fabrics having a width of 1.8 m were juxtaposed and fixed to each other near their longitudinal edges in an overlapping manner, as shown in FIG. 2. This resulted in woven fabric strips with a total width of approximately 14 m.

For the mutual connection of the longitudinal edges, a non-vulcanized rubber strip 4 of suitable width and thickness (in this Example, 5 mm thick and 5 cm wide) can be inserted between the edges, and this edge zone can be vulcanized in a hot press; see FIG. 2. In this process, the cords 1, 2 are sufficiently embedded and anchored into the rubber strip 4. The upper and/or undersides of the connection zone can optionally be covered with a protecting strip 5 during the vulcanization. This prevents sticking together of the rubber strips when winding or unwinding the strip.

The thus-produced fabric strip possesses a tensile force in the direction of the warp of 200 kN per meter of fabric width. In practice, it sometimes happens that at both longitudinal edges of the strip an extra fabric strip is fixed with a slightly higher tensile strength and that the eventual outer edges of these strips are bordered with a rubber strip vulcanized to them to prevent unraveling of the outer edges. Moreover, to the transverse starting end of the mat, thick steel plates can be vulcanized to make handling (with cranes, etc.) possible. These plate connections must obviously form a sufficiently large contact surface with the fabric end embedded in the rubber to support the total load of the suspended strip and ballast weights. Therefore, the connection strength must be at least 200 kN per running meter of plate connection when the fabric tensile force in the longitudinal direction is 200 kN/m. Hence, good adhesion of the rubber to the plate is essential. With the application of an end connection according to FIG. 3, the thickness of the plate 8 and the counterplate 12 was 15 mm. The diameter of a tube 10 was 25 mm. Clamping bolts 13 were fitted every 20 cm across the width of the fabric strip.

Now the ballast weights are tied by means of cords 6 to the fabric strips. In their turn, these cords are attached to hooks which engage through the fabric meshes around the weft groups 3. The clamping force of the warp on the weft is such that every place of attachment can support at least 250 kg without noticable deformation of the surrounding meshes. This clamping effect has the further consequence that the local loading in a point of attachment is substantially 50% transmitted to the surrounding warp groups. This stimulates an even load distribution throughout the entire fabric, or respectively, the entire fabric strip.

The zinc coating on the relatively thin steel cords also produces the result that, on the one hand, the corrosion resistance against (sea)water is improved, so that the durability of the strip remains sufficient, and that, on the other hand, a good adhesion of the cords in the rubber strips is ensured.

Although the fabric of the invention is specifically applicable as an open-mesh underwater covering mat, other applications are also contemplated. For example, these fabrics can be used as a supporting structure or reinforcing structure for flexible strips or sheets. Also holders or floats can be attached to the fabrics instead of ballast blocks, or a combination of ballast weights and floats with flexible sheets. In this way, for example, artificial soils can be formed for aquaculture with a regulatable depth of immersion by using floats which can be inflated to different selected degrees.

The fabrics can also be covered with a plastic coating, for example, by heating them and passing them through a fluidized bed of plastic powder. This improves the corrosion resistance. Moreover, an anti-fouling material can be incorporated into the plastic (for example, Cu-Ni-powder) or a known lime-like substance can be deposited on the fabrics to serve as a feeding bed for raising crustaceans.

What is claimed is:

1. A dimensionally stable, flexible and open-mesh woven fabric, comprising:

a plurality of interwoven warp and weft elements comprised of thread-like elements, wherein the warp elements are arranged in groups comprising a plurality of warp elements extending parallel to one another with each warp element extending sinusoidally so that it alternately extends over and under the weft elements, said weft elements being axially movable with respect to said groups of warp elements, wherein said groups are spaced apart from each other and the distance between each two successive groups as well as the distance between each two successive wefts is between about 0.8 cm and 6 cm, and wherein the number of warp elements in said groups and said spacing are selected so that the clamping force of a group of the warp elements on the weft elements is such that an axial movement of the weft elements occurs only in the case of an axial tensile loading of at least about 1% of the breaking strength of the weft elements.

2. A fabric according to claim 1, wherein the number of warp elements in said groups and said spacing are selected so that said clamping force is such that axial movement occurs only in the case of an axial tensile loading on the weft elements of at least about 2% of the breaking strength of the weft elements.

3. A fabric according to claim 2, wherein the number of warp elements in said groups and said spacing are selected so that the clamping force is such that said movement occurs only at an axial tensile loading having a value of at least about 10% of the breaking strength of the weft elements.

4. A fabric according to claim 1, wherein the elements comprise steel cords.

5. A fabric according to claim 1, wherein each group of warp elements comprises an even number of between one and fifteen identical elements.

6. A fabric according to claim 4, wherein the warp cords and weft cords are of the same type.

7. A fabric according to claim 1, wherein the following equation is satisfied in an unloaded fabric $$15\,D \leqq \frac{b}{\Sigma n_i d_i^4} \leqq 60\,D$$

wherein D is the thickness of the weft elements, $d_i$ is the diameter of the filament "i" in a warp cord, and $n_i$ is the number of filaments with diameter $d_i$ in this cord.

8. A woven fabric strip comprising a plurality of juxtaposed fabrics according to claim 1, wherein the longitudinal edges of the juxtaposed fabrics overlap each other and are mutually connected by means of a vulcanized rubber strip.

9. A fabric strip according to claim 8, further comprising at least one ballast weight attached to said woven fabric strip at spaced locations.

10. A fabric strip according to claim 8, further comprising at least one float member attached to said woven fabric strip at spaced locations.

11. A fabric strip according to claim 8, further comprising a plate and a vulcanized rubber layer connecting said plate to the lateral end of the fabric strip.

12. A fabric strip according to claim 11, further comprising a tube, a counter-plate and a plurality of clamping bolts attaching said plate and counter-plate together, wherein the end of the fabric strip is looped around said tube to form a region of double layer thickness of fabric, and said region is clamped between said plates with the interposition of at least one vulcanized rubber layer.

13. A fabric according to claim 4, wherein said steel cords have a diameter between about 0.10 mm and 2 mm and a tensile strength between about 400 and 3500N/mm$^2$.

14. A fabric according to claim 1, wherein said groups comprise only said parallel-extending warp elements.

15. A fabric according to claim 14, wherein each group of warp elements comprises a plurality of pairs of warp elements.

16. A fabric according to claim 1, wherein each group of warp elements comprises a plurality of pairs of warp elements.

17. A fabric according to claim 16, wherein each group of warp elements comprises six warp elements.

18. A fabric according to claim 17, wherein said warp and weft elements comprise steel cords having a thickness of about 1.3 mm and a breaking load of about 1950N, wherein the distance between weft elements is about 18 mm, the width of each group of warp elements is about 12 mm and the distance between said groups is about 28 mm.

19. A fabric according to claim 1, wherein the warp elements have a tensile strength and a rigidity which do not differ by an order of magnitude from the weft elements.

* * * * *